US005393226A

United States Patent [19]

Groom

[11] Patent Number: 5,393,226

[45] Date of Patent: Feb. 28, 1995

[54] WARE SUPPORT APPARATUS

[76] Inventor: Bryan Groom, 10 Barwood Avenue, Church Lawton, Stoke-On-Trent, Staffordshire, ST7 3EN, England

[21] Appl. No.: 39,039

[22] PCT Filed: Oct. 7, 1991

[86] PCT No.: PCT/GB91/01739

§ 371 Date: Apr. 6, 1993

§ 102(e) Date: Apr. 6, 1993

[87] PCT Pub. No.: WO92/06342

PCT Pub. Date: Apr. 16, 1992

[30] Foreign Application Priority Data

Oct. 9, 1990 [GB] United Kingdom ..... 9021873

[51] Int. Cl.[6] ..... F27D 5/00

[52] U.S. Cl. ..... 432/258; 211/41

[58] Field of Search ..... 432/258, 259; 264/57-59; 211/41

[56] References Cited

U.S. PATENT DOCUMENTS

| | | | |
|---|---|---|---|
| 1,084,980 | 5/1931 | Hardesty . | |
| 3,681,817 | 8/1972 | Lovatt | 432/259 |
| 4,184,841 | 1/1980 | Robinson et al. | 432/258 |
| 4,504,224 | 3/1985 | Hewitt | 432/258 |
| 4,636,170 | 1/1987 | Stupka | 432/258 |
| 4,872,554 | 10/1989 | Quernemoen | 432/259 X |

FOREIGN PATENT DOCUMENTS

| | | |
|---|---|---|
| 0348245 | of 1931 | United Kingdom . |
| 0406809 | of 1934 | United Kingdom . |
| 1047808 | of 1966 | United Kingdom . |
| 1554233 | of 1979 | United Kingdom . |
| 2076509 | of 1981 | United Kingdom . |

*Primary Examiner*—William E. Tapolcai
*Attorney, Agent, or Firm*—Smith-Hill and Bedell

[57] ABSTRACT

Apparatus suitable for supporting a plurality of asticles of glazed vitrified flatware. The apparatus comprises a base and cover each having a generally T-shaped configuration. Uprights extend between respective holes in the base and cover adjacent the free end of each of the limbs of the T. A plurality of spaced fingers extend perpendicularly from the elongate portion inwardly of the apparatus. The fingers are of a greater length than the distance between the rim and the foot of a conventional item of flatware. A groove is provided on the upper surface of the fingers adjacent the free ends thereof for locating a conventional pin for supporting ware beneath the foot of the ware.

2 Claims, 7 Drawing Sheets

WARE SUPPORT APPARATUS

This invention relates to ware support apparatus and particularly but not exclusively to apparatus for supporting glazed flatware during firing by either conventional or fast firing processes.

The term 'pin' when used in this specification is hereinafter to be understood as referring to a short length of a ceramic material which is detachably mountable in kiln furniture to support ware thereon during firing. Pins are typically made of, or have a high content of, alumina or a similar refractory material. Pins are usually in the order of 25 mm long, and have a triangular cross-section such that ware is supported on an apex of the pin. Pins are normally used for only one firing.

A problem encountered with existing kiln furniture is that much of it requires dismantling during loading and unloading. Alternatively, or in addition, the furniture has tended to have a relatively large mass in relation to the ware being fired and thus consumes a considerable amount of heat. Vitreous ware, such as fine bone china, is generally supported during firing at the unglazed foot rather than the rim, to eliminate 'placing marks' on the rim.

Conventional furniture providing foot support has tended to have both of the above mentioned disadvantages. Further, with products suited to fast firing techniques problems have been encountered with thermal shocking of kiln furniture with a relatively large mass of solid material.

A feature with flatware is that the distance between the rim and foot is substantially constant irrespective of the size of the ware.

According to the present invention there is provided ware support apparatus comprising a base having three limbs extending away from a common meeting point, a top cover of a corresponding shape, three uprights mountable between the cover and base each extending from a one of the limbs, and means provided on the uprights to detachably mount a plurality of ware support members in a spaced relationship whereby to support a plurality of articles of ware, the ware support members being mountable so as to be able to provide support spaced from the limbs whereby to support the articles of ware beneath the feet thereof.

The ware support members are preferably mountable spaced from the limbs the ware support members being mountable so as to be able to provide support spaced from the limbs whereby to support the articles of ware beneath the feet thereof.

The ware support members are preferably mountable spaced from the limbs.

The ware support members may comprise pins, or alternatively sleeves which fit over the mounting means.

The base and cover may have a generally 'T' shaped configuration, or may alternatively have a generally 'Y' shaped configuration.

Support member mounting means may also be provided on the base.

The uprights preferably locate in holes in the cover and base, the holes desirably being located adjacent the wet free ends of the limbs. Passages and/or openings are preferably provided through the cover and/or base whereby to prevent thermal shock occurring therein.

The support member mounting means may comprise a plurality of spaced limbs provided on each of the uprights extending substantially perpendicularly to the longitudinal direction thereof.

A groove may be provided on an upper surface of the spaced limbs to locate a pin thereon and a further groove may be provided on the lower surface giving a reversible component.

The spaced limbs may be removably mountable on the uprights, which may be by virtue of a sleeve on the spaced limbs in which is located the uprights. The sleeves on the spaced limbs are preferably shaped to provide the required spacing. As an alternative spacer sleeve members may be provided to locate between adjacent spaced limbs on an upright to provide the required vertical spacing.

Alternatively the spaced limbs may locate in transverse openings in the uprights which may extend fully through the uprights. A head may be provided on the spaced limbs engagable with an outer side of the uprights.

Embodiments of the present invention will now be described by way of example only with reference to the accompanying drawings, in which.

Figure 1:
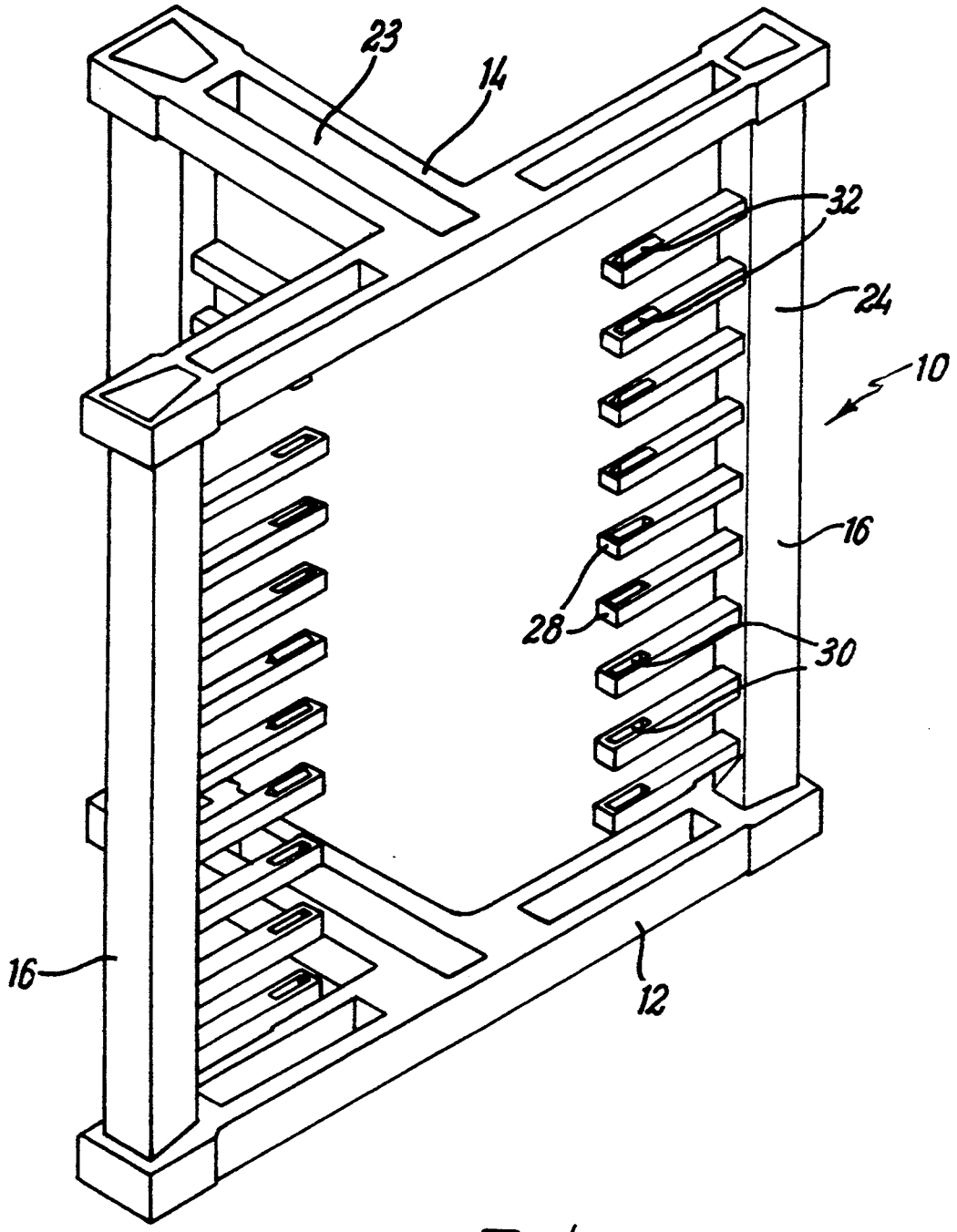
FIG. 1 is a perspective view of article support apparatus according to the invention.
Figure 2:
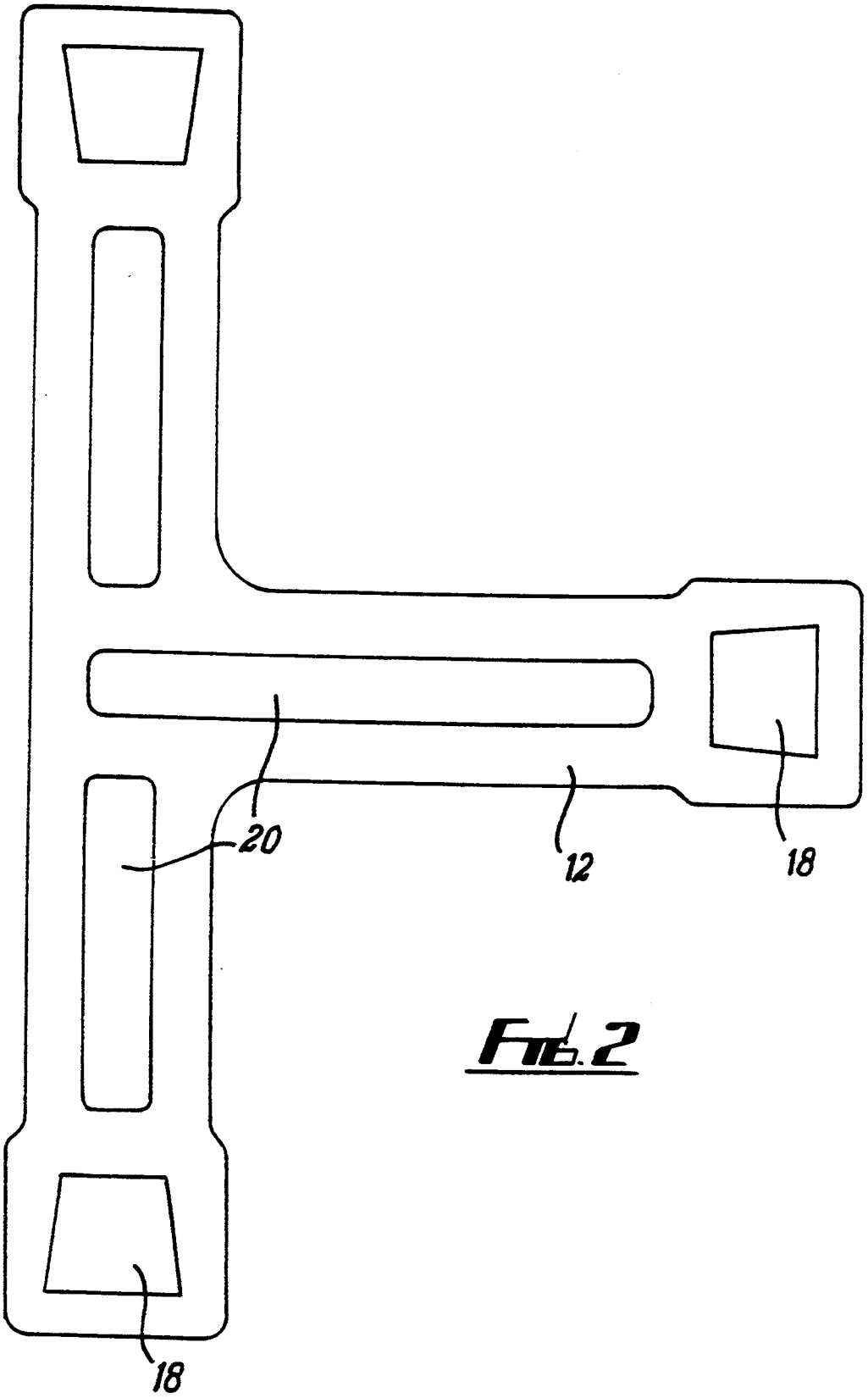
FIG. 2 is a plan view of the base of FIG. 1.
Figure 3:
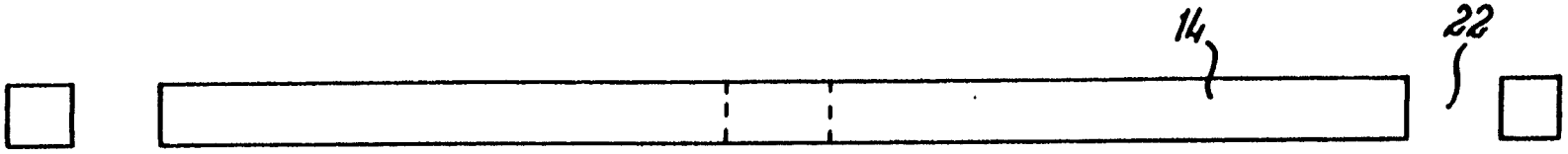
FIGS. 3 and 4 are respectively diagrammatic side views of the cover and base of the apparatus of FIG. 1.
Figure 4:
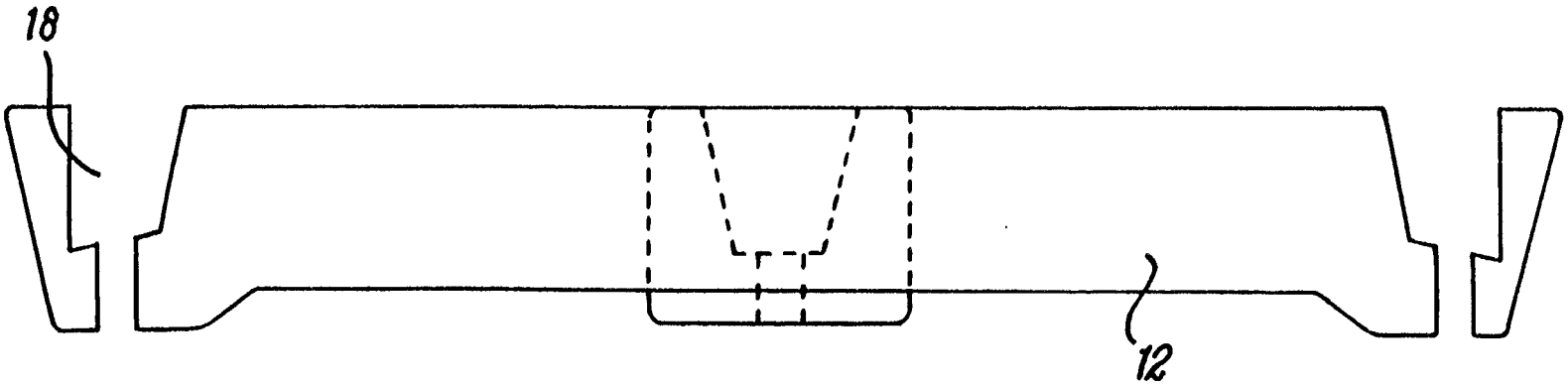

FIGS. 1 to 4 show apparatus 10 suitable for supporting a plurality of articles of glazed vitrified flatware, such as fine bone china plates. The apparatus 10 comprises a base 12, cover 14 and three uprights 16 extending between the base 12 and cover 14.

The base 12 has a generally 'T' shaped configuration. A hole 18 is provided adjacent the free end of each of the limbs of the 'T'. The hole 18 decreases in size downwardly and has a lower portion of considerably reduced size. An elongate passage 20 is provided through each of the limbs. The cover 14 has a similar shape to the base 12 but is not as thick, Again a hole 22 is provided adjacent the free end of each of the limbs of the 'T'. The hole 22 has a constant cross-section. Passages 23 are also provided through each of the limbs.

Figure 5:
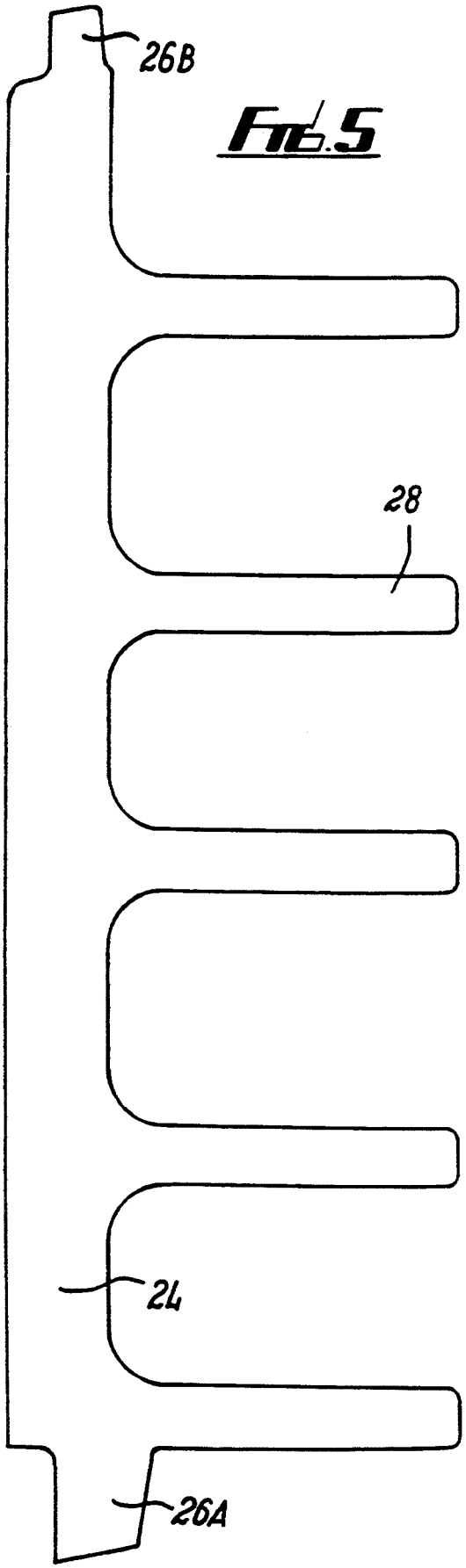
FIG. 5 is a side view of an upright usable with the invention.

The uprights 16 comprise an elongate portion 24 of trapezoidal cross-section with lugs 26A+B at respective ends thereof of a suitable size to fit respectively in the holes 18 and 22. A plurality of spaced fingers 28 extend perpendicularly from the elongate portion 24. The fingers 28 are of a greater length than the distance between the rim and foot of a conventional item of flatware. A groove 30 is provided on the upper surface of the fingers 28 adjacent the free ends thereof. The groove 30 is of a size to locate a conventional pin 32. FIG. 5 shows a similar upright 24 to the uprights 16 except that a smaller number of fingers 28 are provided.

In use, the apparatus 10 is assembled as shown in FIG. 1 with an upright 16 extending out of each of the holes 18 with the lugs 26B locating in the holes 22 of the cover 14. Pins 32 are placed in the grooves 30 as required and articles of flat ware can be slid into the apparatus from the base of the 'T' to be supported on pins 32 on respective fingers 28. The size of the base 12 and cover 14 is obviously chosen such that the limbs of the 'T' are longer than the radius of the item of flatware.

There is thus described apparatus for supporting a plurality of articles of glazed vitrified flatware which has a number of advantageous features. The apparatus 10 has a relatively low mass which provides a saving in energy costs. The use of less material also obviously provides for a reduction in raw materials cost during manufacture. The smaller amount of material means there will be less dust and dirt produced which can damage ware during firing. The apparatus has a relatively open configuration reducing the possibility of thermal shock occurring and thus permitting use in fast firing processes. The open configuration provides for a good air circulation around the ware and allows all round visibility of the supported ware for operators.

The 'T' shape configuration permits ware to be slid on to the apparatus without disassembly. This shape also permits automatic loading and unloading to be carried out if required. The apparatus is modular thereby permitting replacement of single components if wear or breakage occurs and also incorporation with existing components. Further similar components can be used with articles of different sizes. The uprights can be of any required length and need not be the conventional length of 30 cm.

Figure 6:
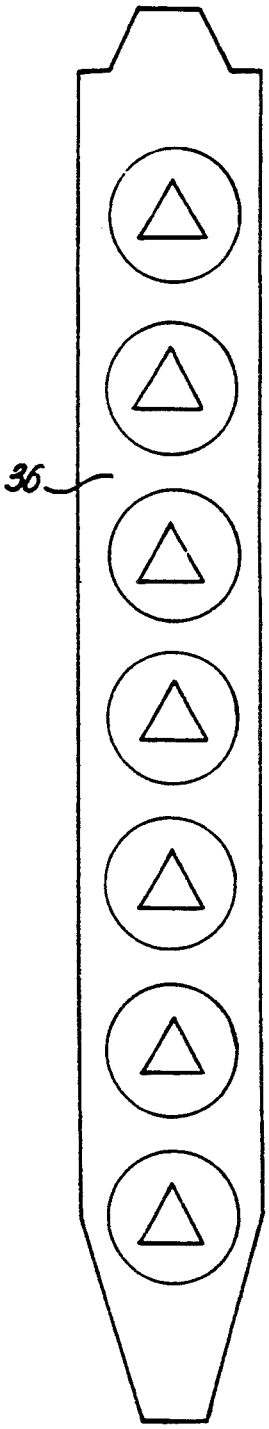
FIG. 6 is a front view of a further upright usable with the invention.

FIG. 6 shows a further upright 36 usable with the base 12 and cover 14 to support glazed articles of earthenware during firing.

Figure 7:
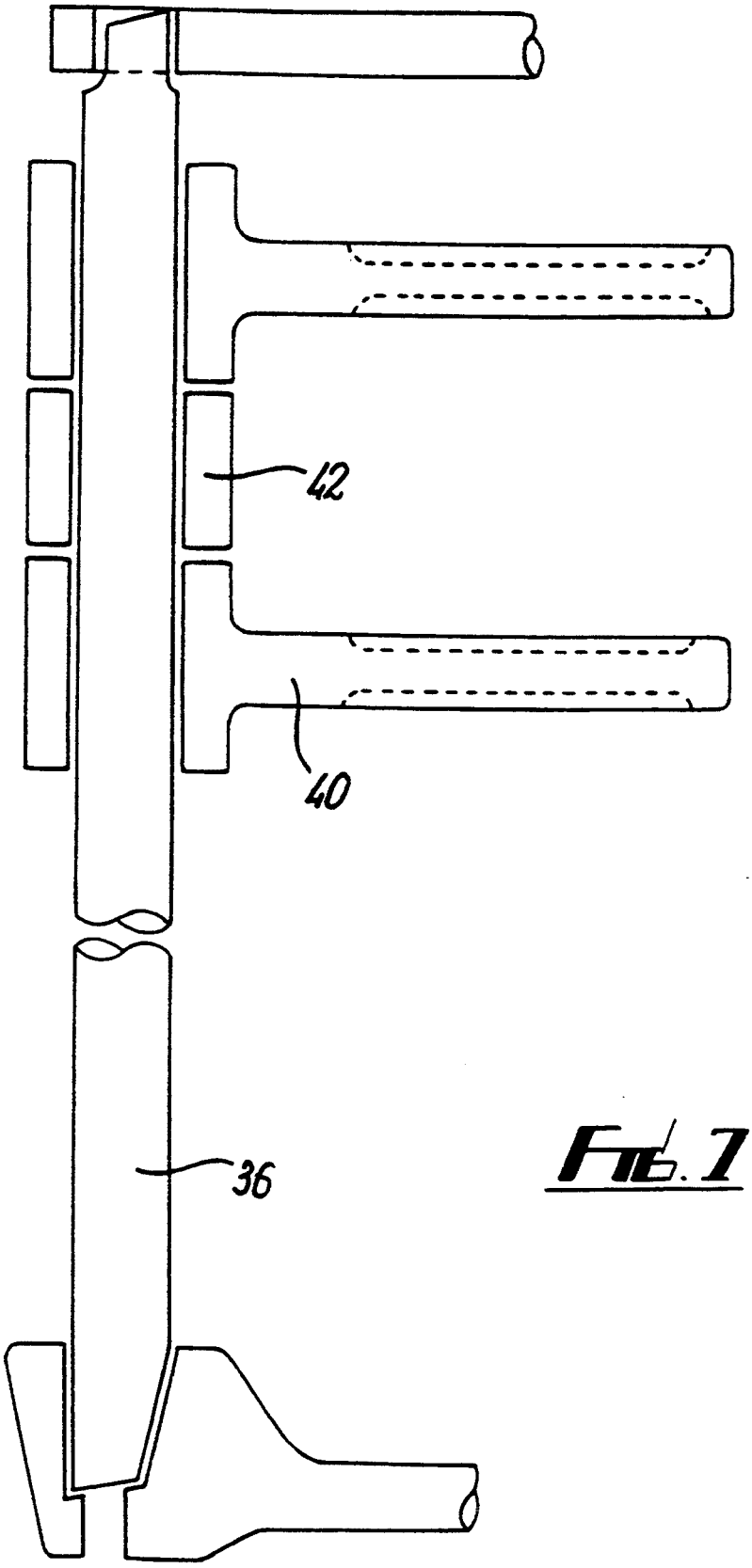
FIG. 7 is a diagrammatic side view of the upright of FIG. 6 in use with other components usable with the invention.

FIG. 7 shows the upright 36, though a plain upright (not shown) without the openings 38 could be used, in a condition suited to support glazed articles of vitrified flatware. Alternately mounted on the upright 36 are detachable spaced fingers 40 and spacer members 42. The fingers 40 have a similar configuration to the fingers 28 except that a sleeve of a shape corresponding to the cross-section of the upright 36 is provided on the end of the finger 42 which locates adjacent the upright 36. The spacers 40 comprise sleeves of a similar shape to provide the required spacing between the fingers 40. Obviously the size of the spacers 42 can be varied if different spacing is required. If the sleeves on the fingers 40 are of a sufficient size spacers can be dispensed with.

The fingers 40 and spacers 42 permit conventional uprights 36 to be used and obviously the same fingers 40 and uprights 36 can be used with different size articles of ware which require different spacing therebetween. This provides for a particularly flexible system. This system also permits freedom of movement of the fingers 40 and spacers 42 during heating and cooling thereby avoiding thermal shock.

Figure 8:
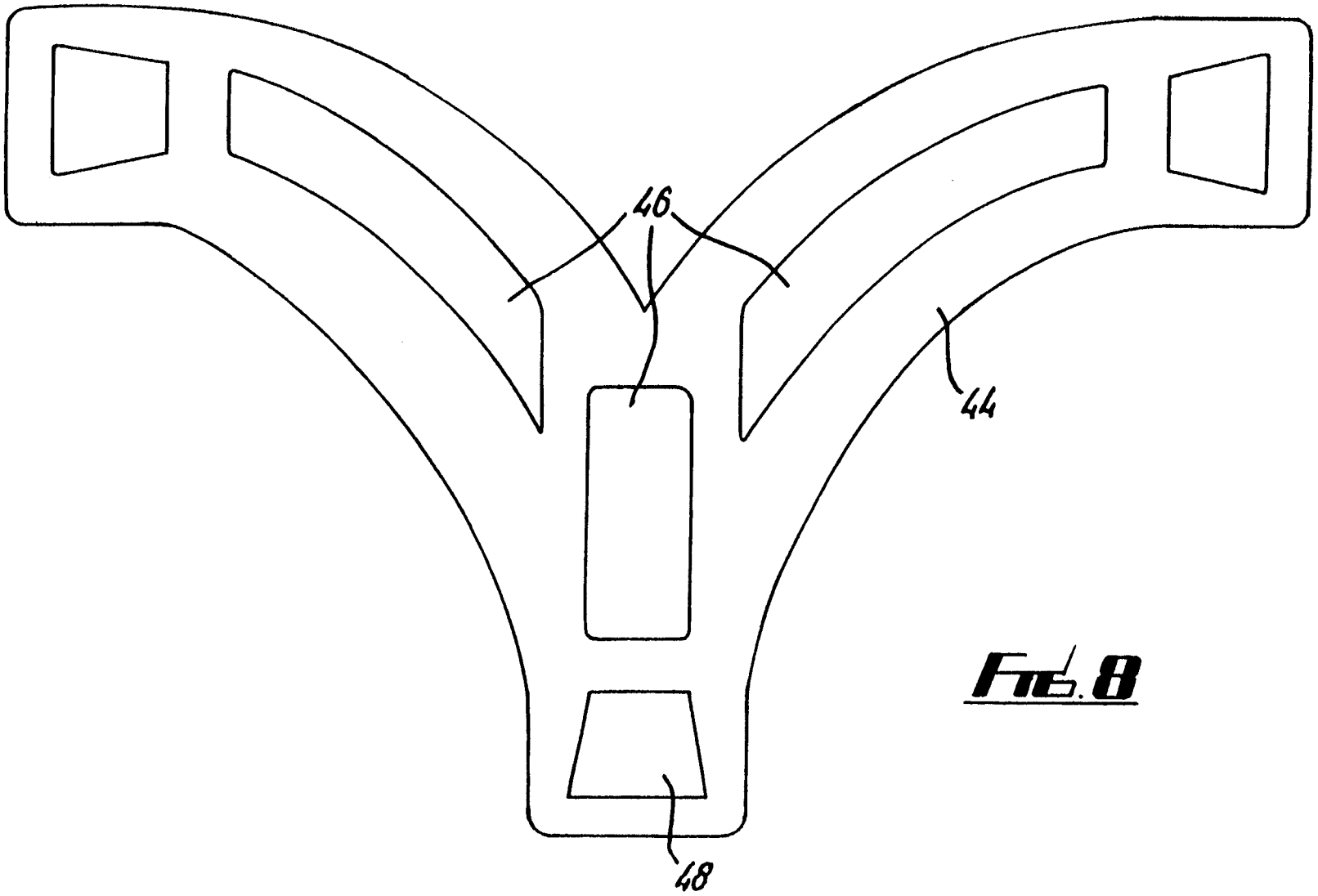
FIG. 8 is a plan view of a further base usable with the invention.

FIG. 8 shows a base 44 which has a generally 'Y' shaped configuration and can be used instead of the 'T' shaped base 12. The base 44 provides additional weight savings over the base 12. The base 44 is provided with passages 46 in each of the limbs to reduce weight and also reduce the likelihood of thermal shocking. Holes 48 are again provided for locating uprights therein.

Figure 9:
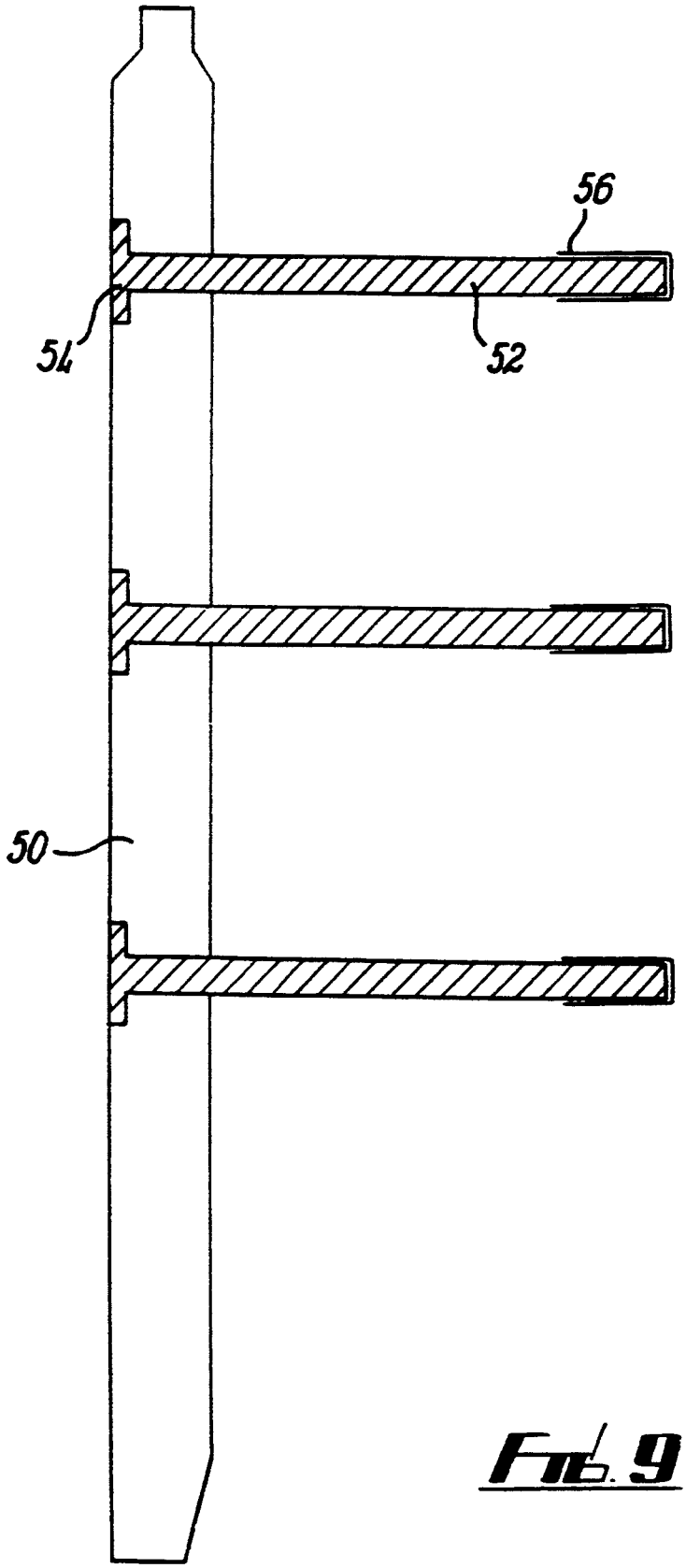
FIG. 9 is a side view of a still further upright and side limbs usable with the invention.

FIG. 9 shows an upright 50 through which passages are provided with recessed openings on the outer side of the upright 50. A support finger 52 is removably fitted through each of the passages with a head 54 of the finger 52 located in the recessed opening of the passage. Provided on the free end of each of the fingers 52 is a ware support sleeve 56 made of a suitable material such as alumina, to support the ware in place of a conventional pin.

The finger 52 and sleeve 56 may have any suitable cross sectional shape such as square, circular, hexagonal, or diamond shape. This arrangement permits ware to be supported close to the upright. The fitting of the head 54 in the recessed opening tends to prevent leaning of the fingers 52. The ware support sleeves 56 can be used in other arrangements than that shown in FIG. 9 and could be used with any of the other arrangements described above, though obviously wider sleeves would normally be needed for such arrangements.

Various other modifications may be made without departing from the scope of the invention as defined by the claims. For example a different configuration of openings may be provided on the base and/or cover. The grooves 30 may be longer to permit the pins 2 to be held in a range of positions. Grooves may be provided on the base to permit an article of ware to be supported thereon.

I claim:

1. Ware support apparatus, for supporting articles of ware that are of predetermined size and have feet, the apparatus comprising a unitary base having three limbs extending away from a common meeting point, a unitary top cover of a corresponding shape, three uprights mounted between the cover and base and each extending from a one of the limbs, two of the uprights being spaced sufficiently far apart to allow the articles to pass therebetween in horizontal orientation and being spaced farther from each other than from the third upright, a plurality of ware support member mounting arms mounted in cantilever fashion on each upright and spaced apart from each other along the upright, a plurality of ware support members mounted detachably on said ware support member mounting arms respectively for supporting such articles of ware, the ware support members being spaced from the uprights for supporting the articles of ware beneath the feet thereof.

2. Apparatus according to claim 1, wherein the ware support member mounting arms extend substantially perpendicular to the respective uprights.

* * * * *